US005370170A

United States Patent [19]

Sander et al.

[11] Patent Number: 5,370,170

[45] Date of Patent: Dec. 6, 1994

[54] METHOD AND CASTING MOLD FOR THE PRODUCTION OF CAST-IRON CYLINDER LINERS

[75] Inventors: Bertil Sander, NygÅrd; Sven-Erik Dahlberg, Skövde; Tibor Szabo, Tibro; Berndt Gyllensten, Skövde, all of Sweden

[73] Assignee: AB Volvo, Goteborg, Sweden

[21] Appl. No.: 41,991

[22] Filed: Apr. 2, 1993

[30] Foreign Application Priority Data

Apr. 2, 1992 [SE] Sweden ..... 9201040

[51] Int. Cl.[5] ..... B22D 7/04; B22D 15/02

[52] U.S. Cl. ..... 164/122.1; 164/33

[58] Field of Search ..... 164/122.1, 122, 125, 164/127, 33; 249/106, 112, 114 R, 135

[56] References Cited

U.S. PATENT DOCUMENTS

| | | | |
|---|---|---|---|
| 2,951,272 | 9/1960 | Kiesler | 164/127 |
| 3,204,301 | 9/1965 | Flemings, Jr. et al. | 164/122.1 |
| 3,568,752 | 3/1971 | Williams | 164/122 |
| 3,620,288 | 11/1971 | Barrow et al. | 164/122.1 |
| 4,484,953 | 11/1984 | Kovacs et al. | 148/3 |
| 4,674,553 | 6/1987 | Witt | 164/33 |
| 4,683,937 | 8/1987 | Hamill, Jr. et al. | 164/364 |

FOREIGN PATENT DOCUMENTS

| | | | |
|---|---|---|---|
| 3509015 | 10/1987 | Germany . | |
| 50-17334 | 6/1975 | Japan | 164/127 |
| 51-41636 | 4/1976 | Japan | 164/122 |
| 55-61368 | 9/1980 | Japan . | |
| 58-29546 | 2/1983 | Japan | 164/122.1 |
| 59-35853 | 2/1984 | Japan . | |
| 321313 | 7/1969 | Sweden . | |
| 28064 | of 1897 | United Kingdom . | |
| 835021 | 5/1960 | United Kingdom . | |
| 1368126 | 9/1974 | United Kingdom . | |
| 1388189 | 4/1988 | U.S.S.R. . | |

*Primary Examiner*—Kurt C. Rowan
*Assistant Examiner*—Erik R. Puknys
*Attorney, Agent, or Firm*—Young & Thompson

[57] ABSTRACT

A method for producing a cast-iron cylinder liner for piston engines in which a metal chill mold (1) is used which has a tubular mold cavity (2) lined with a layer of a hardening molding material or green sand (3). The melt (7) is introduced into the mold cavity from above in such a manner that the cooling effect from the chill mold and the lining provides a frontage of solidification directed upwardly from the bottom.

6 Claims, 1 Drawing Sheet

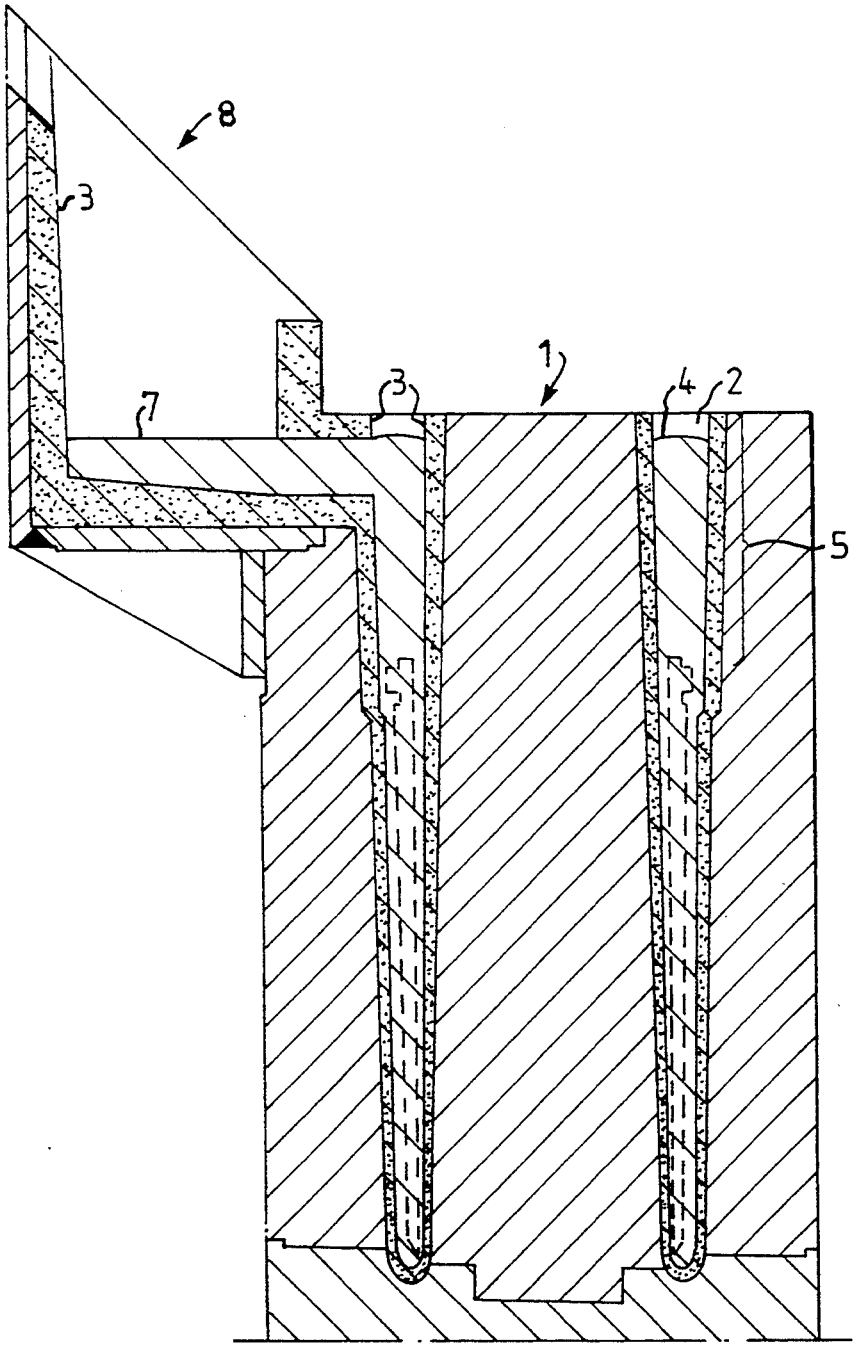
8
3
7
3
1
4
2
5

METHOD AND CASTING MOLD FOR THE PRODUCTION OF CAST-IRON CYLINDER LINERS

TECHNICAL FIELD OF THE INVENTION

The present invention relates to a method for the production of a tubular cast-iron component, preferably a cast-iron cylinder liner for use in piston engines. The invention further relates to a casting mold for use in said method.

BACKGROUND OF THE INVENTION

Cylinder liners for car and truck engines are normally centrifugally cast. The reason for this is that the phosphorous-alloyed grey iron which is normally employed is almost impossible to cast in a conventional green sand mold because the iron is particularly susceptible to shrinkage. In centrifugal casting, a heated mold is employed which is made up of rotating tube, the mold cavity of which having a thin layer of an insulating material. Due to the effect of the centrifugal forces, the shrinkage of the cast product is compensated for.

Centrifugal casting does however impart limitations as to the strength of the material due to the fact that the quick cooling during solidification i.a. precludes high alloying with carbon-stabilizing alloying elements and low $C_{eq}$, these being the most common measures which can be employed to increase strength. Other disadvantages are that the centrifugal casting breaks up the first precipitated reinforcing primary austenitic dendrites in the structure and centrifugally separates primary austenite and graphite eutecticum at low $C_{eq}$.

In order to avoid these problems, cylinder liners could, for example, be cast in stable molds of cold hardening mold material or core sand, though such molds are very expensive and detrimental to the environment.

SUMMARY OF THE INVENTION

It is an object of the present invention to provide a molding method which is particularly, though not exclusively, intended for the production of cast-iron cylinder liners to thereby achieve a low-cost and environmentally-friendly production technique of such cast products which have a higher strength than those obtained by centrifugal casting.

This is achieved in accordance with the present invention by means of the walls of a tubular, upwardly open mold cavity in a metal chill mold being lined with a layer of an insulating mold material, with the cast-iron melt being introduced from above in such a manner that the cooling effect from the chill mold and the lining provides a frontage of solidification directed upwardly from the lower end of the lining to a header volume at the top for the lastly solidified iron.

The layer of insulating mold material is preferably a hard and relatively thin (in the order of 5 to 15 mm) sand shell of a hardening molding material with suitable known organic or inorganic binders produced by known methods, or green sand. The shaping is achieved with the help of a pattern having the shape of the object. This is introduced into the mold cavity of the chill mold, whereafter the sand shell is created in the gap between the pattern and the wall of the chill mold by introducing sand using a common core-forming machine or by pressing.

In accordance with the invention, by ensuring that the solidification is strongly directed from the bottom of the mold cavity and upwards, the risk of shrinkage porosity in the cast object is eliminated since the lastly solidified iron is located in the header volume. The method has been shown to impart such a high reduction of $C_{eq}$ and increase in the alloying content that the ultimate tensile strength of the cylinder liners is raised by 40% and the modulus of elasticity by 20% compared to centrifugally cast cylinder liners. Despite a high phosphate content, no shrinkage pores are formed.

Further scope of applicability of the present invention will become apparent from the detailed description given hereinafter. However, it is to be understood that the detailed description and specific examples, while indicating preferred embodiments of the invention, are given by way of illustration only, since various changes and modifications within the scope of the claimed invention will become apparent to those skilled in the art from this detailed description.

BRIEF DESCRIPTION OF THE DRAWINGS

The present invention will be described in greater detail in the following by way of example only and with reference to the attached drawing which shows a longitudinal sectional view through a casting mold for casting cylinder liners.

DETAILED DESCRIPTION OF PREFERRED EMBODIMENTS

In the drawing, reference numeral 1 denotes a thick-walled steel chill mold presenting a tubular mold cavity 2 which is closed at its base and open at its top. The walls of the mold cavity are lined with a layer 3 of insulating material, preferably hardening molding material or green sand.

The chill mold 1 is intended for the production of a cylinder liner blank 4. The mold cavity 2 presents a conical profile adapted to the elongated shape of the liner, the upper region of which serves as a header volume 5 for the melt. In the drawing, for the sake of clarity, a finished liner is indicated by dashed lines.

In the shown embodiment, casting is effected by pouring the melt 7 from a ladle or from a melting furnace having a pouring basin 8, though the melt may also be poured directly into the mold cavity 2. In one possible production arrangement, four to eight chill molds are positioned along a line or in a circle. Casting takes place via a pouring basin with a runner to each mold.

The method according to the invention has been developed primarily for the production of cast-iron cylinder liner blanks having a wall thickness of 8 to 20 mm, in particular grey iron having the following alloying elements and percentage content:

| | | | | | | | |
|---|---|---|---|---|---|---|---|
| C: | 2.4–3.2; | Si: | 1.60–2.20; | Mn: | 0.5–1.0; | S: | <0.12; |
| P: | 0.3–0.8; | Cr: | 0.8–1.3; | Mo: | 0.1–1.0; | V: | 0.1–0.3. |

It has been shown to be suitable for cylinder liner blanks with these thicknesses and alloying elements to use a sand shell layer of 5 to 15 mm thickness. By making the layer thinner in the lower region of the mold cavity, preferably 5 to 10 mm, and thicker in the upper region, preferably 10 to 15 mm (as shown in the drawing), the melt will be more quickly cooled in the lower region, which further contributes to the control of the transfer of the frontage of solidification upwardly from the bottom.

The slow solidification in the sand-shell insulated chill mold permits greatly reduced $C_{eq}$ and higher content of carbide-stabilizing alloying elements. In this manner, the ultimate tensile strength, fatigue strength and modulus of elasticity can be increased considerably, which implies that the cylinder liners can be dimensioned more thinly, which in turn implies that for a given cylinder block size the cylinder capacity is greater, or that the strength and stiffness margins in the construction are increased.

The high alloying content of carbide-stabilizing elements further implies that the volume and the hardness of the wearing phase in the cylinder liner iron, steadite, increases. This is due to the quantity of cementite in the steadite increasing. Compared to normal phosphor-alloyed cylinder liner iron, the quantity is increased from normally circa 4% steadite at 0.6% phosphor to circa 7%, thereby offering improved wear resistance.

In traditional centrifugal casting, the thickness of the insulation layer and the mold temperature varies. However, the sand shell insulated chill mold which is employed in the method according to the present invention has a stable, constant insulating effect. This results in even solidification and cooling rates, which in turn provide more constant hardness and strength levels, machinability, etc., in other words generally better quality.

With the highest stipulated alloying quantities, the hardness is relatively high because the cooling effect of the chill mold becomes significant at the pearlite transformation temperature, circa 750° C. This can detrimentally affect machining somewhat.

In order to avoid the pearlite hardness becoming unnecessarily high, in a further embodiment of the method according to the invention a method has been developed which reduces the cooling rate at just the pearlite transformation so that the pearlite becomes less compacted and thus softer. This is achieved by removing the liner in its austenitic state, 800°–1050° C., from the mold and immediately transferring it to, and immersing it in, an insulating medium, preferably vermiculite in powdered form, and maintaining it there until the temperature of the liner has dropped below the pearlite transformation temperature.

In this manner, the low $C_{eq}$ and the alloying elements can be fully utilized to achieve a favourable solidification structure which has greatest effect on the desired properties without the pearlite hardness being unnecessarily high.

What is claimed is:

1. Method for producing a cast-iron cylinder liner, comprising: providing an upwardly open tubular mold cavity in a metal chill mold, said mold cavity having an open top, a closed bottom, an inner wall, an outer wall, an upper region, and a lower region; lining the walls of said tubular mold cavity with a layer of an insulating molding material so as to form a lining, said insulating layer extending from the bottom to the top of the mold cavity on both the outer and inner walls, and providing a wall thickness in the lower region which is thinner than the wall thickness in the upper region; and introducing into said mold cavity cast-iron melt in such a manner that a cooling effect from the chill mold and the lining provides a frontage of solidification directed upwardly from a lower end of the lining to a header volume at an upper end where iron solidifies last.

2. Method according to claim 1, wherein the tubular mold cavity is lined with a hardening molding material.

3. Method according to claim 1, wherein the tubular mold cavity is lined with green sand.

4. Method according to claim 1, wherein the insulating layer has a wall thickness ranging from 5–15 mm.

5. Method according to claim 4, wherein the cylinder liner is of high-tensile grey iron, and the mold cavity is filled with a cast-iron melt having the following alloying elements and percentage content:

| | | | | | | | |
|---|---|---|---|---|---|---|---|
| C: | 2.4–3.2; | Si: | 1.60–2.20; | Mn: | 0.5–1.0; | S: | <0.12; |
| P: | 0.3–0.8; | Cr: | 0.8–1.3; | Mo: | 0.1–1.0; | V: | 0.1–0.3. |

6. Method according to claim 4, further comprising reducing the hardness of pearlite in the cylinder liner by removing the liner from the mold cavity in an austenitic state, and while in said state, immersing said liner in vermiculite powder, and maintaining the liner immersed until the liner has cooled to a temperature below 750° C.

* * * * *